United States Patent [19]

Duchemin

[11] 4,026,466

[45] May 31, 1977

[54] SYSTEM FOR FASTENING A RAIL TO ITS SUPPORT

[75] Inventor: Michel Duchemin, Lambres les Douai, France

[73] Assignee: Ressorts du Nord S.A., Paris, France

[22] Filed: Nov. 18, 1975

[21] Appl. No.: 632,977

[30] Foreign Application Priority Data

Nov. 29, 1974 France ..... 74.39300

[52] U.S. Cl. ..... 238/349; 238/310

[51] Int. Cl.[2] ..... E01B 9/30

[58] Field of Search ..... 238/310, 338, 349, 351; 267/140, 152; 248/24, 25

[56] References Cited

UNITED STATES PATENTS

| | | | |
|---|---|---|---|
| 3,003,825 | 10/1961 | Kemble | 267/152 X |
| 3,430,857 | 3/1969 | Matsubara et al. | 238/349 X |

FOREIGN PATENTS OR APPLICATIONS

| | | | |
|---|---|---|---|
| 249,315 | 1/1964 | Australia | 238/349 |
| 1,099,124 | 8/1955 | France | 238/349 |
| 707,301 | 5/1966 | Italy | 248/24 |

*Primary Examiner*—Robert J. Spar
*Assistant Examiner*—Randolph A. Reese
*Attorney, Agent, or Firm*—Burns, Doane, Swecker & Mathis

[57] ABSTRACT

This system for fastening a rail comprises an elastically yieldable fastener and a clamping device which extends through the fastener, an elastically yieldable block provided with a central aperture for the passage of the clamping device and a cap. The cap is in the form of a cup which is provided with a central aperture and is extended around the cup aperture by a tubular sleeve. The block is placed in the cap. The internal volume of the cap is less than the volume occupied by the block when it is compressed, whereby, in the course of the clamping of the clamping device, the lateral expansion of the block is limited by the cap and its axial elasticity is maintained.

18 Claims, 9 Drawing Figures

SYSTEM FOR FASTENING A RAIL TO ITS SUPPORT

Rails are very often fastened to their support, at the present time, by means of a fastener constituted by a spring strip through which extends clamping means anchored in the support of the rail so that the strip is clamped against the rail flange and against the support. The clamping means is placed as near as possible to the edge of the rail so as to oppose movements of the latter. Consequently, the branch of the fastener which overlaps the flange of the rail is short and this limits the flexibility of the strip. Now usually the rail is placed on an elastically yieldable sole pad so that a rather flexible strip is required to apply to the rail a force which is substantially constant notwithstanding the compression of the sole.

Consequently, in order to permit higher speeds of the trains and ensure an improved comfort of the latter, the rail must be clamped with greater force and the flexibility of the pads must be increased and this entails the use of fasteners which are increasingly flexible. As moreover the aperture for the passage of the clamping means weakens the strength of the strip, the increase in the flexibility of the latter is difficult to achieve. Further, when the rail must be electrically insulated there is usually disposed between the clamping means and the strip, in the vicinity of the aperture of the latter, an insulating member which must be rigid to ensure that it is not deteriorated by its contact with the clamping means. This produces in the vicinity of the aperture concentrations of stresses which reduce the strength of the strip. The latter must therefore have greater thickness, which is hardly compatible with the desired flexibility.

An object of the present invention is to increase the flexibility of the rail fastener without reducing the thickness of the strip, that is to say, while retaining all the qualities of strength of the strip owing to the combination of the strip with an elastically yieldable device.

According to the invention, there is provided a system for fastening a rail which comprises an elastically yieldable block provided with a central aperture for the passage of the clamping means, the block being in contact with the side of the fastener remote from the support, and a cap in the form of a cup which is interposed between the block and the clamping means and has a central apparatus and is extended around its central aperture by an inner tubular sleeve which extends into the central aperture of the block, the internal volume of the cap being less than the volume occupied by the block when the block is compressed whereby, when under the clamping effect of the clamping means the block is compressed against the fastener, the lateral expansion of the block is limited by the cap and whereas the axial elasticity of the block is maintained.

The block is made from rubber or any other solid material capable of assuming the shape of the enclosure in which it is compressed and elastically resuming its initial shape when the compression ceases. This block may have very diverse shapes. It is in contact with the end wall of the cap, at least on a circular line coaxial with the aperture, but it may also be in contact with the whole of the end wall of the cap and leave only a free space between the block and the lower part of the sleeve. When it is compressed against the fastener for fastening a rail it fully fills the internal space of the cap and extends outside the latter so as to be applied along the fastener on a continuous surface around the clamping means so that the forces exerted by the clamping means on the cap are distributed over the fastener in an even manner. Even when it is in position on the fastener and fills the cap, the elastically yieldable block maintains a certain axial elasticity which enables the assembly to become deformed when the rail vibrates and thus imparts the necessary flexibility to the fastening system. This block is always insulated from the clamping means by the tubular sleeve and consequently there is no danger of a seizure occurring therebetween.

It will be understood that this elastically yieldable device can be maintained on the fastener merely by the clamping means or it may be rendered integral with the strip itself for example by means of a beading provided at the end of a cylindrical extension of the elastically yieldable block, the tubular sleeve then being extended around the clamping means so as to preclude the accidental separation of the beading from the strip.

Features and advantages of the invention will be apparent from the ensuing description of embodiments of the invention given solely by way of examples with reference to the accompanying drawings in which.

Figure 1:
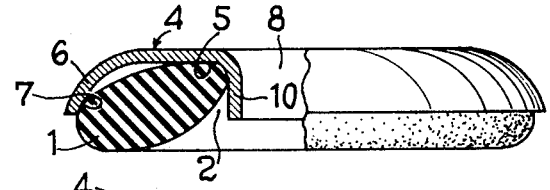
FIGS. 1, 2, 3 and 4 are partly elevational and partly sectional views of various embodiments of the elastically yieldable device according to the invention.

The elastically yieldable device adapted to increase the flexibility of the fastening of a rail on its support comprises, as shown in FIGS. 1–4, an elastically yieldable block 1 of rubber or other material capable of being compressed in an enclosure and capable of elastically resuming its initial shape. The block 1 is provided with a central aperture 2. The block 1 is placed in a camp 4 which partly surrounds it. This cap has substantially the shape of a cup which comprises a lateral skirt 6 and a central aperture 8 defined by a cylindrical sleeve 10, the sleeve 10 extending into the aperture 2 of the block 1.

The block 1 is in contact with the end wall of the cap 4 at least along a circular line 5 coaxial with the aperture 2. This line may be for example located, as shown in FIG. 1, in the vicinity of the junction between the sleeve 10 and the end wall of the cap 4.

Preferably, the block is also in contact with the cap 4 along another circuit line 7 located in the vicinity of the end of the skirt 6.

In any case, the block 1 has a volume exceeding the inner volume of the cap 4 not only when at rest or uncompressed as shown in FIG. 1 but also when it is clamped inside the cap. The end of the skirt 6 and the end of the sleeve 10 are substantially in the same plane and the block 1 extends beyond this plane.

Figure 2:
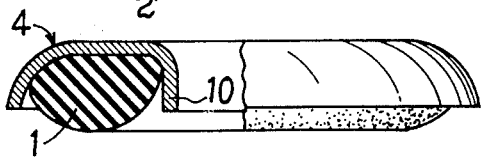

The block 1 may also be in contact with the whole of the surface of the end wall of the cap 4 as shown in FIG. 2. In this case, as in the case shown in FIG. 1, its outer surface is curved so that a free space is formed therebetween and the lower part of the sleeve 10. The block could also have other shapes depending on the use and the nature of the forces to compensated for.

Figure 5:
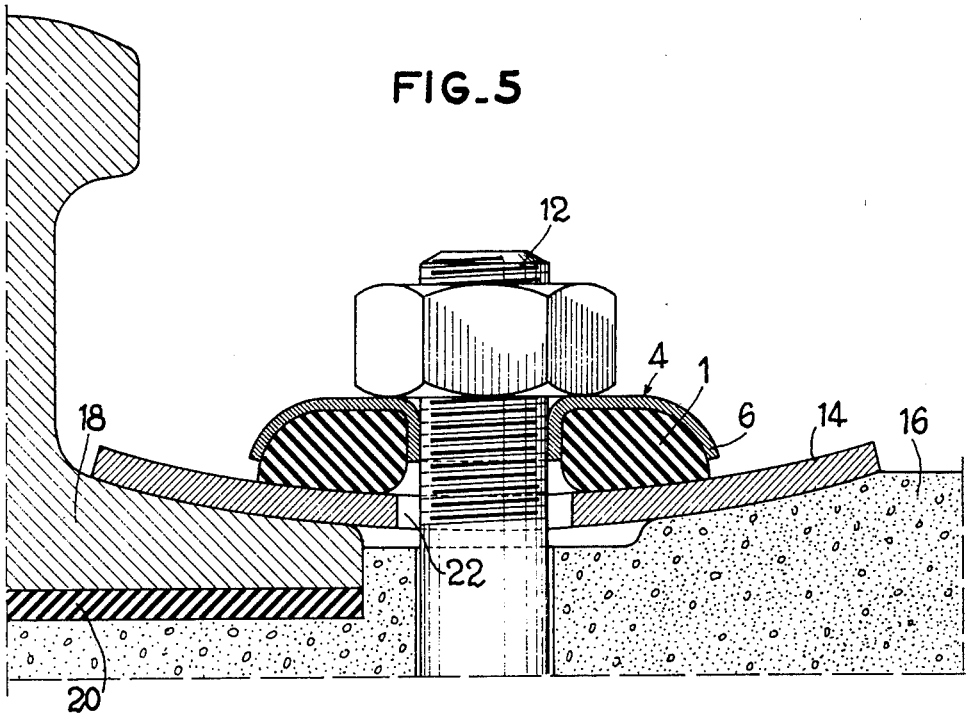
FIG. 5 is a sectional view of a rail fastening system comprising an elastically yieldable device according to the invention.

When in use, the elastically yieldable device is mounted around a clamping means 12 for a rail fastener constituted by an elastically yieldable strip 14 which bears against the support 16 of the rail and also against the rail flange 18, the flange 18 being moreover placed on an elastically yieldable sole or pad 20 which is in contact with the support 16. The fastener 14 is provided with an aperture 22 through which the clamping means 12 extends with clearance, this clamping means being anchored in the support 16 (see FIGS. 5 and 6).

The elastically yieldable device is placed in such manner that the block 1 is in contact with the fastener 14 around the aperture 22. The clamping means has its head portion bearing on the cap 4 and is placed inside the sleeve 10 which insulates it from the block 1.

The clamping means 12 is clamped in such manner that the block 1 is compressed inside the cap 4 and completely fills the inner volume of the latter. The skirt 6 and the sleeve 10 limit the lateral expansion of the block 1 and cause the material thereof to bear against the fastener 14. The nature of this material ensures that the clamping forces are evenly distributed inside the block 1 and consequently over the fastener 14. Moreover, the block 1 retains a certain elasticity and the skirt 6 remains at a slight distance from the fastener 14. Moreover, no flow or creep of the material is to be feared so that the block may support high pressures which are applied solely on the surface it covers.

When the rail 18 moves vertically, the movements of the fastener 14 are transmitted to the block 1 which deforms inside the cap, or between the latter and the fastener, and then resume its initial position. The assembly constituted by the elastically yieldable device and the fastener then has a flexibility higher than that of the fastener alone. Moreover, the distribution of the forces over the fastener relieves the center part of the fastener which is weakened by the aperture 22 so that the clamping force may even be increased if necessary.

Figure 6:
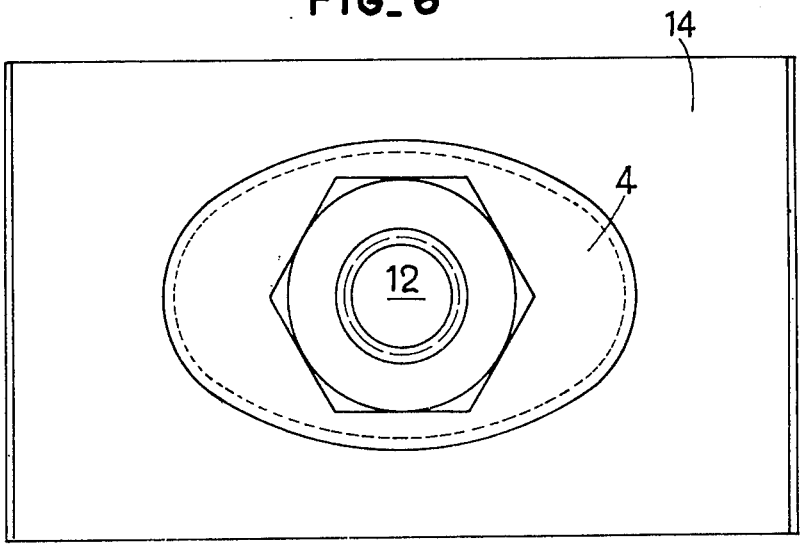
FIG. 6 is a plan view of the fastener of the system shown in FIG. 5

Preferably, the block 1 and the cap 4 have an oval outer shape as shown in FIG. 6 whereas the sleeve 10 has a circular section. However, as some fasteners have an aperture 22 of oval shape, the sleeve 10 may have an oval section although the clamping means 12 is cylindrical, so as to avoid relative angular displacement of the fastener and cap.

Figure 7:
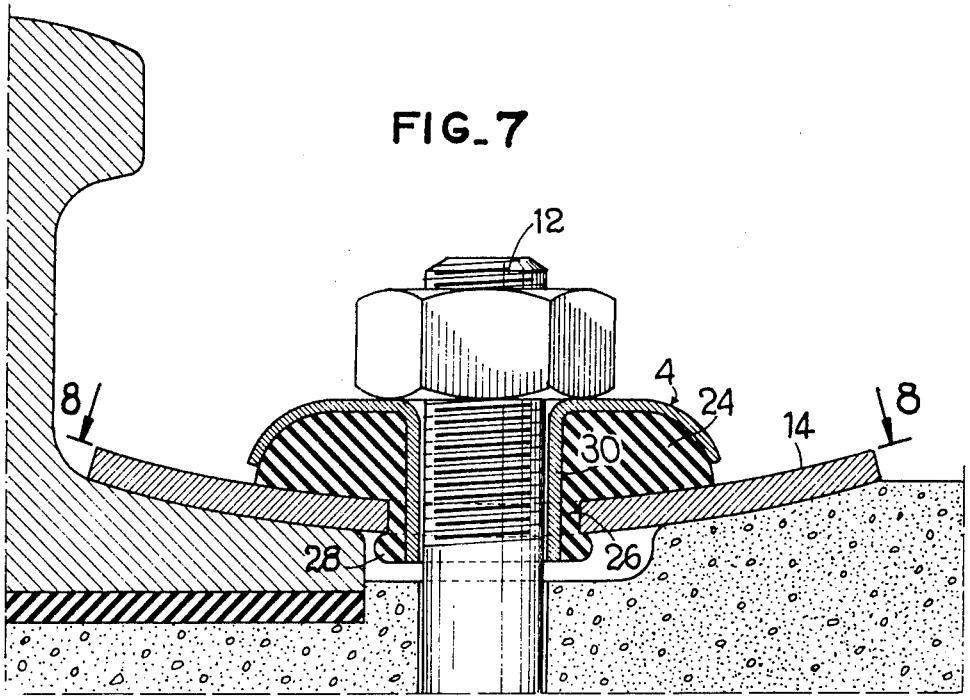
FIG. 7 is a sectional view of a modification of the rail fastening system.
Figure 8:
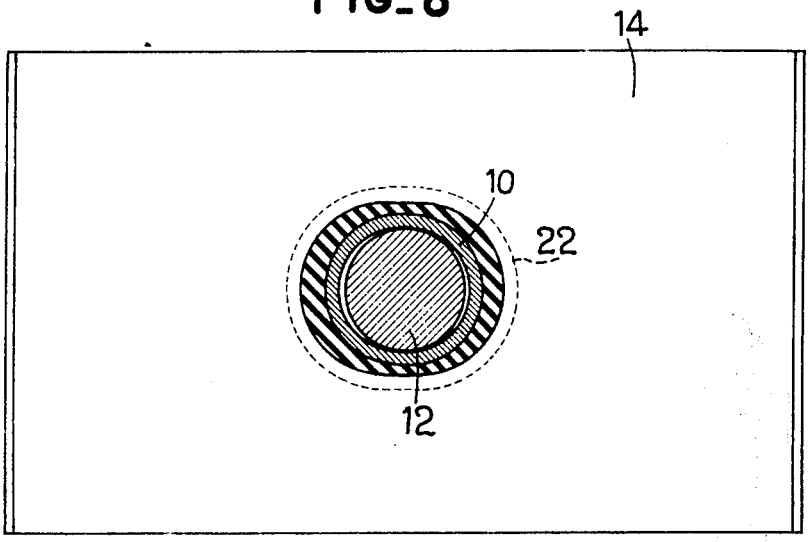
FIG. 8 is a sectional view taken on line 8—8 of FIG. 7.

It may also be of utility to render the fastener and the elastically yieldable device integral with each other before the mounting thereof on the rail. In this case, as shown in FIGS. 7 and 8, the elastically yieldable block 24 is extended around the central aperture by a spigot 26 which terminates in its lower part in a beading or enlargement 28. Likewise, the sleeve of the cap is extended at 30 throughout the length of the spigot 26. The assembly is then introduced in the aperture 22 of the fastener 14 and locked on this fastener by the beading 28 which is maintained in the locking position by the sleeve 30.

It will be understood that when the aperture 22 is oval, the spigot 26 has a thickness which is variable along its periphery so as to have an oval outer shape corresponding to the shape of the aperture 22 and an inner surface of a shape corresponding to the shape of the sleeve 30.

The block 24 provided with a spigot 26 may have, in the uncompressed state, a shape similar to that of the block 1 shown in FIGS. 1 and 2. It may also have a slightly different shape, for example have a planar surface 22 outside the cap 4 which is perpendicular to the axis of the sleeve 10 and a substantially planar surface 34 which is inclined with respect to the surface 32 between the two lines of contact with the cap 4 so as to impart thereto a substantially trapezoidal section (FIG. 3).

A recess 35 is formed around the sleeve 10 above the spigot 26 in the vicinity of the junction of the sleeve 10 with the end wall of the cap 4 in order to facilitate expansion of the rubber or other elastically yieldable material.

Figure 3:
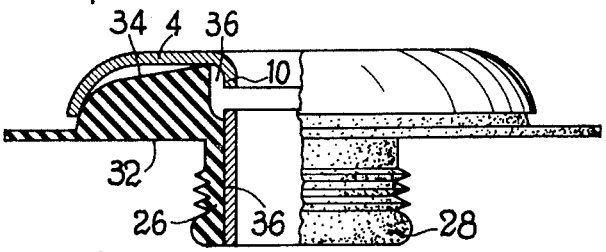
Figure 4:
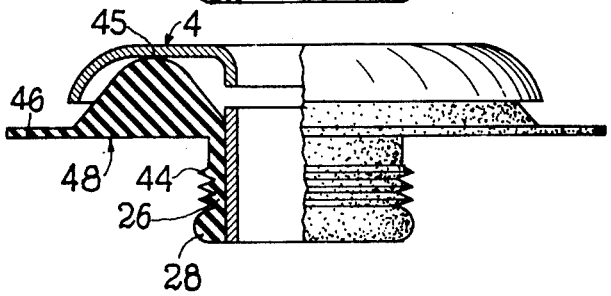

The sleeve 10 is in one piece with its extension 30 or, as shown in FIGS. 3 and 4, extended by an independent tube 36 which is coaxial thereto but placed at a certain distance from its end. In any case, the spigot 26 is strictly separated from the clamping means 12 so that it is never capable of hindering the clamping effect of this means by becoming wedged in the screwthreads of the clamping means.

It will be understood that the shape of this block is determined by the extent of the vertical movements of the rail. This block could simply have a toric shape or, as shown in FIG. 4, a substantially triangular cross-sectional shape with a rounded apex which comes in contact with the end wall of the cap 4 along a circular line 45 located in the vicinity of the median part of this end wall. The surface of the block opposed to this rounded apex is constituted by a planar surface 48 which is similar to the surface 32 and extended laterally by a sheet portion 46 and axially by the spigot 26.

Other shapes may also be employed to advantage.

This elastically yieldable device may be employed in fastening systems comprising fasteners of various shapes and forms and it is in no way limited to the system comprising a single rectangular elastically yieldable strip such as the illustrated fastener 14. For example the fastener may have a variable thickness or be curved so as to have two parallel branches through which branches the clamping means extends. It may also be formed from a plurality of superimposed portions through which the clamping means extends. The elasticity of the block permits this block to adapt itself exactly to the profile of this fastener even if it comprises bosses or recesses.

Figure 9:
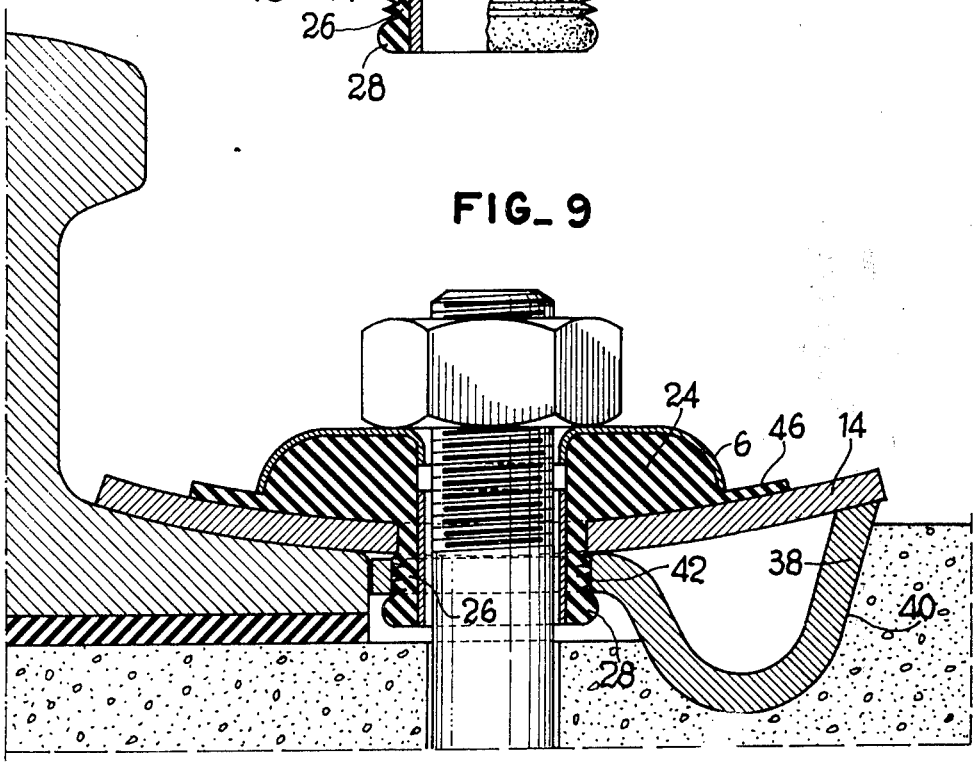
FIG. 9 is a sectional view of a rail fastening system according to another embodiment.

FIG. 9 shows an embodiment of a fastening system in which the elastically yieldable fastener is formed by a spring strip similar to the strip 14 and by a curved abutment 38 which bears against a shoulder 40 provided in the support 16. This abutment or stop has an aperture 42 similar to the aperture 32 of the strip 14 through which the spigot 26 of the block 24 extends, this spigot being maintained therein by the beading 28 so that the abutment 38 is rendered integral with the strip 14 by the elastically yieldable device itself.

Preferably, the spigot 26 has, in addition to the beading 28, rather deep grooves or corrugations 44 which ensure the locking of the abutment 38 and prevent its displacement with respect to the fastener 14. The fastening system thus obtained constitutes an assembly which may be very easily placed in position on the support merely by mounting the clamping means.

The elastically yieldable material of the block 34 may be easily an electrical insulator so that it performs both the function of a reinforcement of the elasticity and an electrical insulation. However, in some cases, when the electrical insulation is important, the block 24 is provided with a lateral sheet portion 46 which is substantially perpendicular to the axis of the sleeve 10 and bears against the fastener 14 over a certain length and insulates the fastener from the cap 4 and consequently from the clamping means.

Irrespective of the embodiment employed, in the position of use, there is always a free space between the lower end of the skirt 6 of the cap 4 and the fastener 14 but the flow or creep of the elastically yieldable block is never to be feared.

The elastically yieldable device according to the invention consequently increases the flexibility and strength of the rail fastening system in an extremely simple manner. Indeed, the absence of a rigid connection between the cap and the block enables the latter to retain all its elasticity whereas the shape of the cap limits the deformation of this block and guide it in such manner as to ensure a close contact with the fastener and an effective absorption of the forces.

Moreover, rail fastening systems employing such a device may be both very flexible and electrically insulating.

Having now described my invention what I claim as new and desire to secure by Letters Patent is:

1. A system for fastening a rail having a flange, the system comprising in combination: a rail support, a fastener including an elastically bendable strip having an upper face, one end portion bearing downwardly on the flange and another end portion supported by the support, the strip defining an aperture, clamping means having an upper part and a lower part which is anchored in the support and extending through said aperture, an elastomer block defining a substantially central aperture through which aperture the clamping means extends, the block being coextensive with a part of said upper face of the strip, and a cup-shaped cap which is interposed between the block and the upper part of the clamping means and comprises an outer skirt portion surrounding and in contact with the block for laterally retaining the block and an inner tubular sleeve portion which defines a central aperture and extends into the aperture of the block and surrounds the clamping means, the block being coextensive with the cap in the compressed condition of the block, the strip being more deformable elastically than the cap by the effect of the clamping means and being in an elastically deformed condition in the system in use while the cap is substantially undeformed by the effect of the clamping means, the cap being spaced from the upper face of the strip when the block is compressed and the strip is elastically deformed by the effect of the clamping means, and the nature of the pressure transmitted by the compressed block to the upper face of the strip being substantially hydrostatic owing to said lateral retention of the block by said skirt portion.

2. A system as claimed in claim 1, wherein the clamping means is isolated from the elastomer material of the block by the sleeve portion of the cap and thus maintains the block in regular contact with the strip, a free space remaining between an edge of the skirt portion and the strip.

3. A system as claimed in claim 1, wherein the block is, in its uncompressed state, in contact with the cap at least along a circular line of an end wall of the cap and defines at least one free space between the block and the lower part of the sleeve portion.

4. A system as claimed in claim 3, wherein the block has in section, in its uncompressed state, a rounded apex tangent to an inner surface of the cap.

5. A system as claimed in claim 3, wherein the block is, in its uncompressed state, in contact with the whole of an inner surface of an end wall of the cap but has a rounded surface outside the cap.

6. A system as claimed in claim 3, wherein the block is, in its uncompressed state, in bearing relation to the cap in the vicinity of the sleeve portion and in the vicinity of the skirt portion.

7. A system as claimed in claim 1, wherein the block has a peripheral sheet portion which is substantially perpendicular to the axis of the central aperture of the block.

8. A system as claimed in claim 1, comprising a cylindrical spigot which extends the block and partly defines the central aperture of the block and is placed inside the aperture of the strip and provided with means for maintaining it in position on the strip.

9. A system as claimed in claim 8, wherein the sleeve portion is extended beyond an outer and lower peripheral edge of the skirt cup portion throughout the length of the spigot.

10. A system as claimed in claim 8, comprising an auxiliary sleeve interposed between the spigot and the clamping means.

11. A system as claimed in claim 8, wherein the fastener comprises a plurality of parts, one of said parts being said strip and each part defining an aperture for the passage of the clamping means, and the block comprises means for maintaining said parts of the fastener together.

12. A system as claimed in claim 11, wherein the spigot terminates in an outer beading.

13. A system as claimed in claim 11, wherein the spigot has corrugations for maintaining a part of the fastener located under said strip.

14. A system as claimed in claim 1, wherein the end of the sleeve portion is substantially in the same plane as an outer and lower peripheral edge of the skirt portion.

15. A system as claimed in claim 1, wherein the block is of an electrically insulating material.

16. A system as claimed in claim 1, wherein the cap is substantially circular in plan.

17. A system as claimed in claim 1, wherein the cap is substantially oval in plan.

18. A system for fastening a rail having a flange, the system comprising in combination: a rail support, a fastener including an elastically bendable strip having an upper face, one end portion bearing downwardly on the flange and another end portion supported by the support, the strip defining an aperture, clamping means having an upper part and a lower part which is anchored in the support and extending through said aperture, an elastomer block defining a substantially central aperture through which aperture the clamping means extends, the block being coextensive with a part of said upper face of the strip, and a cup-shaped cap which is interposed between the block and the upper part of the clamping means and comprises an outer skirt portion surrounding and in contact with the block for laterally retaining the block and an inner tubular sleeve prtion which defines a central aperture and extends into the aperture of the block and surrounds the clamping means, the block being coextensive with the cap in the compressed condition of the block, the cap having in plan a convex curvilinear outer shape in two end portions of the cap which are located on opposite sides of a vertical plane parallel to the rail, the strip being more deformable elastically than the cap by the effect of the clamping means and being in an elastically deformed condition in the system in use while the cap is substantially undeformed by the effect of the clamping means, the cap being spaced from the upper face of the strip when the block is compressed and the strip is elastically deformed by the effect of the clamping means, and the nature of the pressure transmitted by the compressed block to the upper face of the strip being substantially hydrostatic owing to said lateral retention of the block by said skirt portion.

* * * * *